US009004861B2

(12) United States Patent
Nash et al.

(10) Patent No.: US 9,004,861 B2
(45) Date of Patent: Apr. 14, 2015

(54) BLADE TIP HAVING A RECESSED AREA

(75) Inventors: Timothy Charles Nash, East Hartford, CT (US); Andrew S. Aggarwala, Vernon, CT (US)

(73) Assignee: United Technologies Corporation, Hartford, CT (US)

( * ) Notice: Subject to any disclaimer, the term of this patent is extended or adjusted under 35 U.S.C. 154(b) by 314 days.

(21) Appl. No.: 13/468,104

(22) Filed: May 10, 2012

(65) Prior Publication Data

US 2013/0302162 A1 Nov. 14, 2013

(51) Int. Cl.

| | |
|---|---|
| ***F01D 5/14*** | (2006.01) |
| ***F01D 5/18*** | (2006.01) |
| ***F01D 5/20*** | (2006.01) |

(52) U.S. Cl.

CPC ..... *F01D 5/20* (2013.01)

(58) Field of Classification Search

USPC ..... 415/1, 115, 173.1, 173.4, 173.5; 416/1, 416/90 R, 92, 96 R, 96 A, 97 R, 224, 228, 416/235, 236 R, 236 A, 237

See application file for complete search history.

(56) References Cited

U.S. PATENT DOCUMENTS

| | | | | |
|---|---|---|---|---|
| 4,682,933 | A * | 7/1987 | Wagner | 415/173.5 |
| 4,884,820 | A | 12/1989 | Jackson et al. | |
| 6,027,306 | A | 2/2000 | Bunker | |
| 6,059,530 | A | 5/2000 | Lee | |
| 6,190,129 | B1 | 2/2001 | Mayer et al. | |
| 6,224,336 | B1 | 5/2001 | Kercher | |
| 6,422,821 | B1 * | 7/2002 | Lee et al. | 416/224 |
| 7,704,047 | B2 | 4/2010 | Liang et al. | |
| 8,075,268 | B1 | 12/2011 | Liang | |
| 8,157,504 | B2 | 4/2012 | Amaral et al. | |
| 2004/0197190 | A1 | 10/2004 | Stec et al. | |
| 2008/0044289 | A1 | 2/2008 | Klasing et al. | |
| 2009/0162200 | A1 | 6/2009 | Tibbott et al. | |
| 2009/0162260 | A1 | 6/2009 | Bera et al. | |
| 2011/0255990 | A1 * | 10/2011 | Diamond et al. | 416/97 R |

OTHER PUBLICATIONS

International Search Report for International Application No. PCT/US2013/039594 dated Aug. 22, 2013.

International Preliminary Report on Patentability for PCT Application No. PCT/US2013/039594, mailed Nov. 20, 2014.

* cited by examiner

*Primary Examiner* — Christopher Verdier

(74) *Attorney, Agent, or Firm* — Carlson, Gaskey & Olds, P.C.

(57) ABSTRACT

An example blade assembly includes, among other things a blade tip having a pressure side and a suction side, and a plurality of grooves within the blade tip. At least one of the grooves has a contour that is different than both a contour of the pressure side and a contour of the suction side.

18 Claims, 3 Drawing Sheets

BLADE TIP HAVING A RECESSED AREA

BACKGROUND

This disclosure relates generally to blades and, more particularly, to recessed areas, such as grooves, within a blade tip of the blades.

Gas turbine engines are known and typically include multiple sections, such as a fan section, a compression section, a combustor section, a turbine section, and an exhaust nozzle section. The compression and turbine sections include rotatable blades. The blades include tips that are radially spaced from an outer diameter of a flow path through the engine.

During operation, some flow moves between the tips of the blades and the outer diameter of the flowpath. This flow forms a vortex on a suction side of the blade. The vortex causes inefficiencies within the engine. The larger the vortex, the greater the inefficiencies.

SUMMARY

A blade assembly according to an exemplary aspect of the present disclosure includes, among other things a blade tip having a pressure side and a suction side, and a plurality of chordwise grooves. At least one of the chordwise grooves has a contour that is different than both a contour of the pressure side and a contour of the suction side.

In a further non-limiting embodiment of the foregoing blade assembly, the chordwise grooves may extend lengthwise between a leading edge and a trailing edge of the blade tip. The chordwise grooves may have a width that is about the same.

In a further non-limiting embodiment of either of the foregoing blade assemblies, the chordwise grooves may be open exclusively on a radially facing side.

In a further non-limiting embodiment of any of the foregoing blade assemblies, the chordwise grooves may be spaced from a perimeter of the blade tip a first distance. The chordwise grooves may have a width that is a second distance, the first distance greater than the second distance.

In a further non-limiting embodiment of any of the foregoing blade assemblies, the blade may include exactly two chordwise grooves.

In a further non-limiting embodiment of any of the foregoing blade assemblies, at least one of the plurality of chordwise grooves may have a contour that follows a contour of a suction side of the blade tip.

In a further non-limiting embodiment of any of the foregoing blade assemblies, the blade tip may have a leading edge and a trailing edge. The plurality of grooves may comprise a longer groove and a shorter groove, the longer groove extending between the leading edge and the trailing edge a first length, and a shorter groove extending between the leading edge and the trailing edge a second length that is less than the first length.

In a further non-limiting embodiment of any of the foregoing blade assemblies, the second length may be about half of the first length.

In a further non-limiting embodiment of any of the foregoing blade assemblies, the longer groove may extend closer to both the leading edge and the trailing edge than the shorter groove.

In a further non-limiting embodiment of any of the foregoing blade assemblies, the blade tip may be a portion of a turbine blade.

In a further non-limiting embodiment of any of the foregoing blade assemblies, the assembly may further include a shelf established in the blade tip.

A blade assembly according to another exemplary aspect of the present disclosure includes, among other things, a blade tip at a radial end portion of a blade. The blade tip includes a nonrecessed area and a recessed area. The recessed area is provided by a plurality of grooves. The nonrecessed area is greater than the recessed area.

In a further non-limiting embodiment of the foregoing blade assembly, the recessed area and the nonrecessed area may each have at least one radially facing surface and an area of the radially facing surface of the nonrecessed area is greater than an area of the radially facing surface of the recessed area.

In a further non-limiting embodiment of any of the foregoing blade assemblies, at least one of the grooves may have a contour that is different than both a contour of a pressure side of the blade tip and a contour of a suction side of the blade tip.

In a further non-limiting embodiment of any of the foregoing blade assemblies, the grooves may extend lengthwise between a leading edge and a trailing edge of the blade tip.

In a further non-limiting embodiment of any of the foregoing blade assemblies, the grooves may be open exclusively on a radially facing side.

In a further non-limiting embodiment of any of the foregoing blade assemblies, the blade tip may include a plurality of cooling holes.

In a further non-limiting embodiment of any of the foregoing blade assemblies, the plurality of grooves may each have a depth and a width, and the depth divided by the width may be from 0.5 to 3.0.

A method of controlling flow over a blade tip according to another exemplary aspect of the present disclosure includes, among other things directing flow over a blade tip into at least a first groove and a second groove, the first groove and the second groove established within the blade tip.

In a further non-limiting embodiment of the foregoing method, the first groove and the second groove may be both longitudinally extending.

In a further non-limiting embodiment of any of the foregoing methods, at least one of the grooves may have a contour that is different than both a contour of the pressure side and a contour of the suction side.

DESCRIPTION OF THE FIGURES

The various features and advantages of the disclosed examples will become apparent to those skilled in the art from the detailed description. The figures that accompany the detailed description can be briefly described as follows.

DETAILED DESCRIPTION

Figure 1:
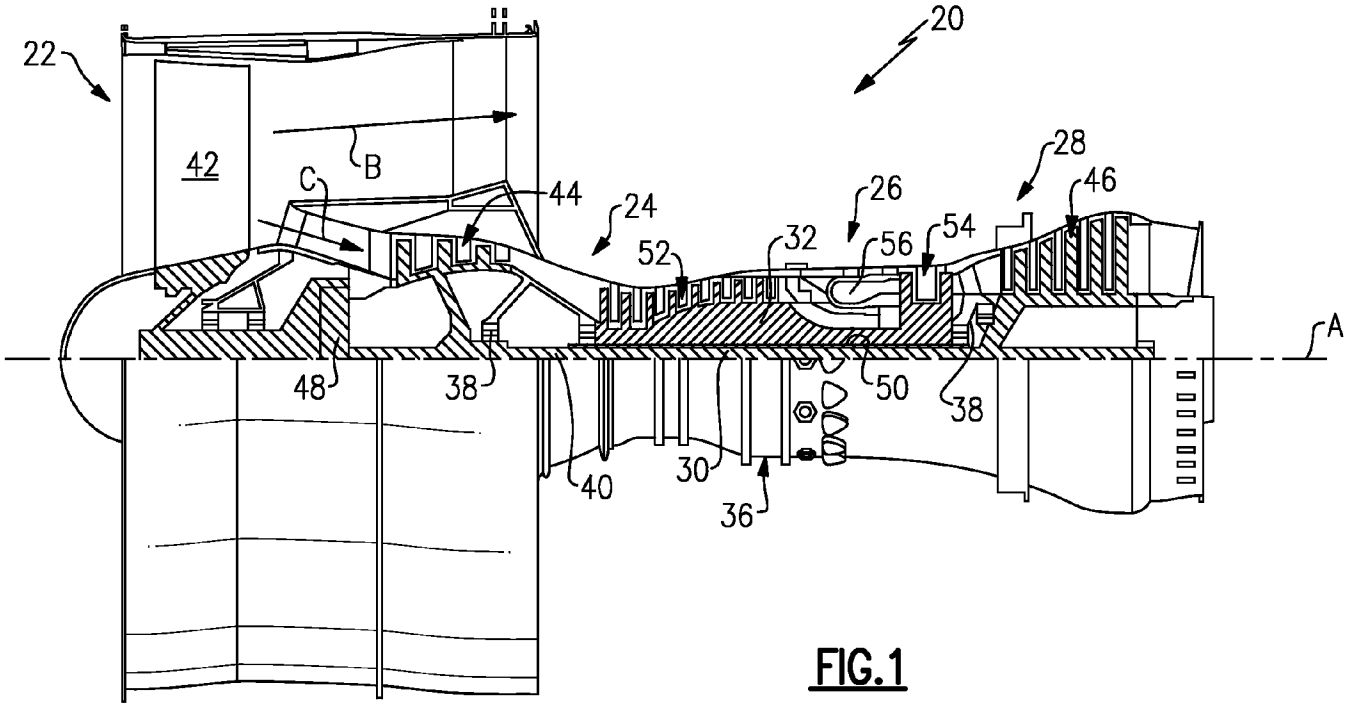
FIG. 1 shows a highly schematic cross-section view of an example turbomachine.

FIG. 1 schematically illustrates an example turbomachine, which is a gas turbine engine 20 in this example. The gas turbine engine 20 is a two-spool turbofan gas turbine engine that generally includes a fan section 22, a compressor section 24, a combustion section 26, and a turbine section 28.

Although depicted as a two-spool turbofan gas turbine engine in the disclosed non-limiting embodiment, it should be understood that the concepts described herein are not limited to use with turbofans. That is, the teachings may be applied to other types of turbomachines and turbine engines including three-spool architectures.

In the example engine 20, flow moves from the fan section 22 to a bypass flowpath B or a core flowpath C. Flow from the bypass flowpath B generates forward thrust. The compressor section 24 drives air along the core flowpath C. Compressed air from the compressor section 24 communicates through the combustion section 26. The products of combustion expand through the turbine section 28.

The example engine 20 generally includes a low-speed spool 30 and a high-speed spool 32 mounted for rotation about an engine central longitudinal axis A relative to an engine static structure 36. The low-speed spool 30 and the high-speed spool 32 are rotatably supported by several bearing systems 38. It should be understood that various bearing systems 38 at various locations may alternatively, or additionally, be provided.

The low-speed spool 30 generally includes an inner shaft 40 that interconnects a fan 42, a low-pressure compressor 44, and a low-pressure turbine 46. The inner shaft 40 is connected to the fan 42 through a geared architecture 48 to drive the fan 42 at a lower speed than the low-speed spool 30.

The high-speed spool 32 includes an outer shaft 50 that interconnects a high-pressure compressor 52 and high-pressure turbine 54.

The inner shaft 40 and the outer shaft 50 are concentric and rotate via bearing systems 38 about the engine central longitudinal axis A, which is collinear with the longitudinal axes of the inner shaft 40 and the outer shaft 50.

The combustion section 26 includes a circumferentially distributed array of combustors 56 generally arranged axially between the high-pressure compressor 52 and the high-pressure turbine 54.

In some non-limiting examples, the engine 20 is a high-bypass geared aircraft engine. In a further example, the engine 20 bypass ratio is greater than about six (6 to 1).

The geared architecture 48 of the example engine 20 includes an epicyclic gear train, such as a planetary gear system or other gear system. The example epicyclic gear train has a gear reduction ratio of greater than about 2.3 (2.3 to 1).

The low-pressure turbine 46 pressure ratio is pressure measured prior to inlet of low-pressure turbine 46 as related to the pressure at the outlet of the low-pressure turbine 46 prior to an exhaust nozzle of the engine 20. In one non-limiting embodiment, the bypass ratio of the engine 20 is greater than about ten (10 to 1), the fan diameter is significantly larger than that of the low pressure compressor 44, and the low-pressure turbine 46 has a pressure ratio that is greater than about 5 (5 to 1). The geared architecture 48 of this embodiment is an epicyclic gear train with a gear reduction ratio of greater than about 2.5 (2.5 to 1). It should be understood, however, that the above parameters are only exemplary of one embodiment of a geared architecture engine and that the present disclosure is applicable to other gas turbine engines including direct drive turbofans.

In this embodiment of the example engine 20, a significant amount of thrust is provided by the bypass flow B due to the high bypass ratio. The fan section 22 of the engine 20 is designed for a particular flight condition—typically cruise at about 0.8 Mach and about 35,000 feet. This flight condition, with the engine 20 at its best fuel consumption, is also known as "Bucket Cruise" Thrust Specific Fuel Consumption (TSFC). TSFC is an industry standard parameter of fuel consumption per unit of thrust.

Fan Pressure Ratio is the pressure ratio across a blade of the fan section 22 without the use of a Fan Exit Guide Vane system. The low Fan Pressure Ratio according to one non-limiting embodiment of the example engine 20 is less than 1.45 (1.45 to 1).

Low Corrected Fan Tip Speed is the actual fan tip speed divided by an industry standard temperature correction of Temperature divided by 518.7^0.5. The Temperature represents the ambient temperature in degrees Rankine. The Low Corrected Fan Tip Speed according to one non-limiting embodiment of the example engine 20 is less than about 1150 fps (351 m/s).

Figure 2:
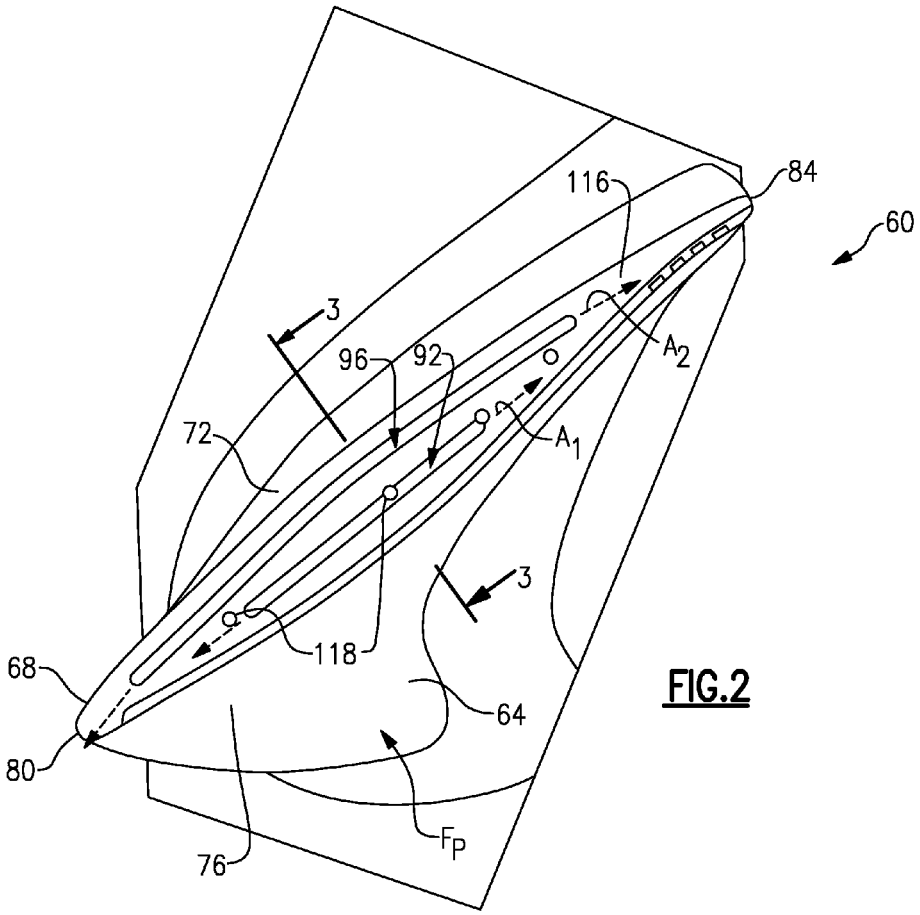
FIG. 2 shows a blade within the gas turbine engine of FIG. 1.
Figure 3:
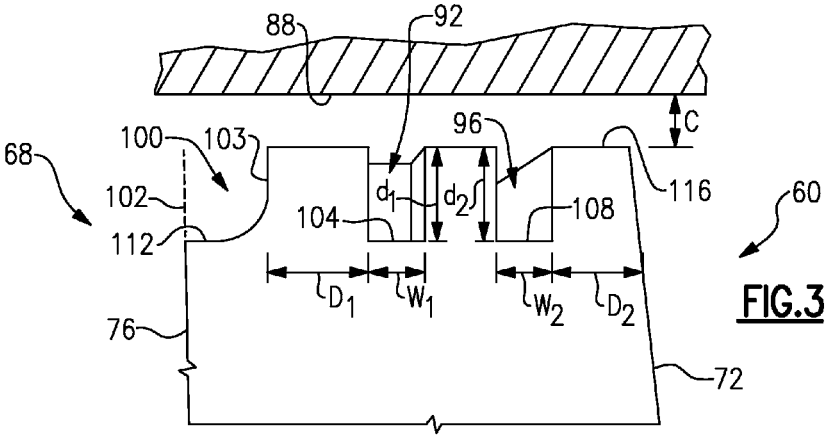
FIG. 3 shows a cross-section view at line 3-3 in FIG. 2.

Referring now to FIGS. 2 and 3 with continuing reference to FIG. 1, an example blade 60 of the gas turbine engine 20 extends radially from a blade base or root 64 to a blade tip 68. The example blade 60 is an unshrouded blade of the high-pressure turbine section 28. A hub (not shown) includes a slot that slideably receives an attachment structure of the blade 60. The root 64 is secured to the attachment structure.

The blade 60 has a suction side 72 and a pressure side 76. The suction side 72 and the pressure side 76 extend from a leading edge 80 to a trailing edge 84 relative to a direction of flow through the gas turbine engine 20. The pressure side 76 and the suction side 72 represent the perimeter of the blade 60 and the blade tip 68.

In this example, the blade tip 68 is configured to at least partially seal against a sealing surface 88 during operation. The sealing surface 88 represents the radially outer diameter of a flowpath through the gas turbine engine 20. In FIG. 3, the radial distance between the blade tip 68 and the sealing surface 88 provides a clearance C. The clearance C has been increased in the FIG. 3 for clarity purposes.

The example blade tip 68 includes a first groove 92 and a second groove 96. The blade tip 68 is generally the radial length of the blade 60 having the first groove 92 and the second groove 96. The grooves 92 and 96 are chordwise grooves in this example as the grooves 92 and 96 extend in a direction generally aligned with a chord of the blade 60.

The first groove 92 and the second groove 96 have a rectangular cross-section and are open exclusively on a radially facing side. Some of the fluid moving over the blade tip 68 moves into the first groove 92 and the second groove 96 through the open, radially facing side. The first groove 92 and the second groove 96 are milled in this example.

The example blade tip 68 includes a blade shelf 100 at the pressure side 76 of the blade 60. The blade shelf 100 is open on a radially facing side and the pressure side 76. In the area of the shelf 100, the pressure side 76 of the blade tip 68 is a radial continuation 102 of the pressure side 76 of other portions of the blade 60. A wall 103 of the blade shelf 100 is spaced from the pressure side 76 of the blade tip 68. The continuation 102, not the wall 103, from a portion of the perimeter of the blade tip 68 in this example.

The first groove 92 includes a groove floor 104, the second groove includes a groove floor 108, and the blade shelf 100 includes a shelf floor 112. The groove floors 104 and 108, and the shelf floor 112, are radially spaced from a surface 116 of the blade tip 68 that interfaces directly with the sealing surface 88.

The first groove 92, the second groove 96, and the blade shelf 100 are recessed relative to the surface 116 and are thus recessed areas of the blade tip 68. The surface 116 represents the nonrecessed area. In the blade tip 68, the nonrecessed area is greater than the recessed area. That is, the total area of the groove floor 104, the groove floor 108, and the shelf floor 112 is greater than the total area of the surface 116.

The cross-sectional shape the first groove 92, the second groove 96, or both may be something other than rectangular. The cross-sectional shape may be angled relative to the surface 116. The groove floors 104 and 108 may be transverse to the surface 116 in some examples.

The first groove 92 and the second groove 96 extend longitudinally between the leading edge 80 and the trailing edge 84 of the blade 60. The first groove 92 extends longitudinally along an axis $A_1$. The second groove 96 extends longitudinally along an axis $A_2$. In this example, the axis $A_2$ of the second groove 96 follows or mimics a contour of the suction side 72 of the blade 60 at the blade tip 68. The axis $A_1$ of the first groove 92 does not follow the contour of the suction side 72. The axis $A_1$ also does not follow the contour of the pressure side 76. The axis $A_1$ extends generally in a chordwise direction.

The first groove 92 is shorter than the second groove 96. In this example, the first groove 92 is about half of the length of the second groove. The second groove 96 extends closer to the leading edge 80 and the trailing edge 84 of the blade 60 than the first groove 92. The longitudinal centers of the first groove 92 and the second groove 96 are generally aligned.

The first groove 92 has a width $W_1$ that is about the same as a width $W_2$ of the second groove 96. The first groove 92 is spaced a distance $D_1$ from the pressure side 76 of the blade 60. The second groove 96 is spaced a distance $D_2$ from the suction side 72 of the blade 60. In this example, each of the widths $W_1$ and $W_2$ are less than either of the distances $D_1$ and $D_2$.

In some examples, the widths $W_1$ and $W_2$ are selected to ensure that the distances $D_1$ and $D_2$ are maintained above a certain amount. The distances $D_1$ and $D_2$ represent the wall thickness.

The first groove 92 has a depth $d_1$, and the second groove 96 has a depth $d_2$. In this example, a ratio of the depth $d_1$ of the first groove 92 divided by the width $W_1$ of the first groove 92 is from 0.5 to 3.0. Also, a ratio of the depth $d_2$ of the second groove 96 divided by the width $W_2$ of the second groove 96 is from 0.5 to 3.0.

Although shown as having two grooves 92 and 96, other examples of the blade tip 68 may include different numbers of grooves. Other types of grooves may extend from the leading edge 80 all the way to the trailing edge 84. However, such an arrangement may encourage flow at the leading edge 80 or the trailing edge 84 to flow into the clearance C.

The blade tip 68 includes cooling hole openings 118. Cooling passages communicate cooling air from an internal area of the blade to the openings 118 to cool the blade tip 68. The openings 118 may be partially, or fully, located within the first groove 92, the second groove 96, or the shelf 100. The blade shelf 100 protects the cooling hole openings 118 from closure due to rub.

During operation, a flow moves from the pressure side 76 to the suction side 72 through the clearance C. The peak $F_p$ of this flow is located at a position about 25 percent the length of the chord of the blade tip 68. The first groove 92 and the second groove 96 discourage this flow through the clearance C. The first groove 92 and the second groove 96 are thus considered flow discouragers or labyrinth seals. Flow discouragers other than grooves are possible.

Figure 4:
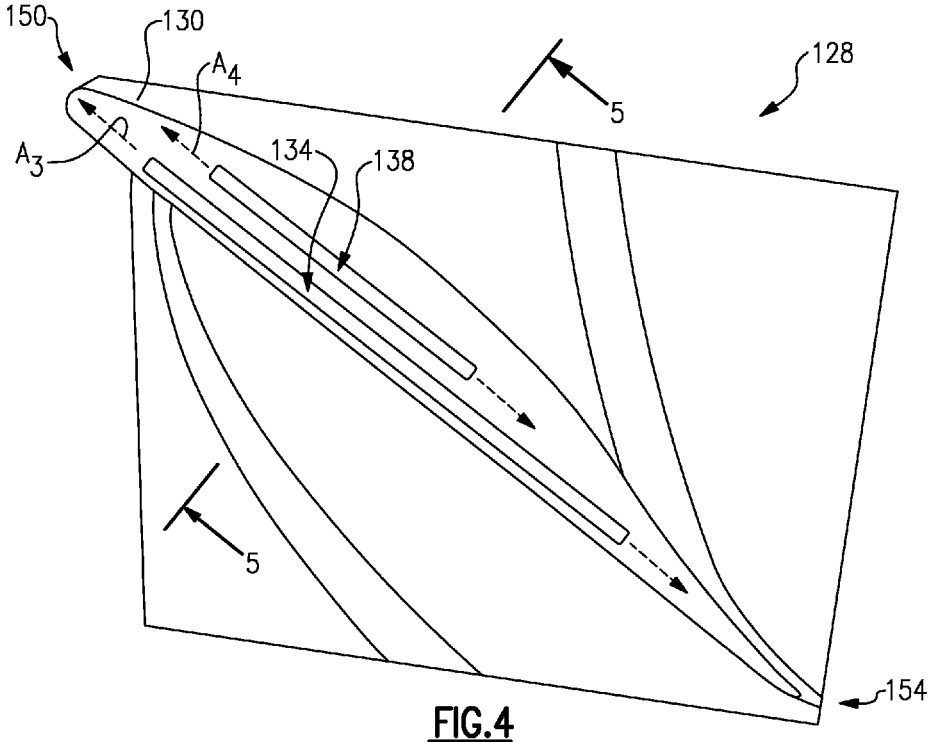
FIG. 4 shows another example blade used within a turbine section of the gas turbine engine of FIG. 1.
Figure 5:
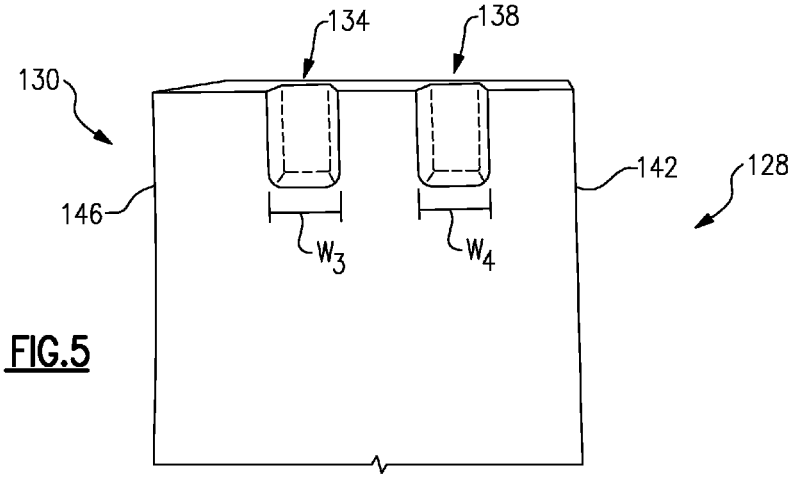
FIG. 5 shows a section view at line 5-5 in FIG. 4.

Referring to FIGS. 4 and 5, another example blade 128 includes a blade tip 130 having two grooves 134 and 138. The blade tip 130 does not include a shelf.

The grooves 134 and 138 extend longitudinally along an axis $A_3$ and an axis $A_4$, respectively. The axes $A_3$ and $A_4$ have a contour that is different than a contour of a pressure side 142 and a suction side 146 of the blade tip 130. The axes $A_3$ and $A_4$ are noncontoured and parallel to each other in this example.

The grooves 134 and 138 extend lengthwise between a leading edge 150 and a trailing edge 154 of the blade tip 130. The grooves 134 and 138 have a width $W_3$ and $W_4$ that is about the same.

Features of the disclosed examples include flow discouragers arranged generally parallel to the camber line of a blade and generally perpendicular to the leakage flow streamline.

The preceding description is exemplary rather than limiting in nature. Variations and modifications to the disclosed examples may become apparent to those skilled in the art that do not necessarily depart from the essence of this disclosure. Thus, the scope of legal protection given to this disclosure can only be determined by studying the following claims.

We claim:

1. A blade assembly, comprising:

a blade tip having a pressure side and a suction side, the blade tip further having a recessed area and a nonrecessed area greater than the recessed area; and a plurality of chordwise grooves within the blade tip, wherein at least one of the chordwise grooves has a contour that is different than both a contour of the pressure side and a contour of the suction side, wherein the chordwise grooves extend lengthwise between a leading edge and a trailing edge of the blade tip, and the chordwise grooves have a width that is about the same, wherein the chordwise grooves are open exclusively on a radially facing side, wherein the chordwise grooves provide at least a portion of the recessed area.

2. The blade assembly of claim 1, wherein the chordwise grooves are spaced from a perimeter of the blade tip a first distance, and the chordwise grooves have a width that is a second distance, the first distance greater than the second distance.

3. The blade assembly of claim 1, wherein the blade includes exactly two chordwise grooves.

4. The blade assembly of claim 1, wherein another one of the plurality of chordwise grooves has a contour that follows a contour of the suction side of the blade tip.

5. The blade assembly of claim 1, wherein the blade tip has a leading edge and a trailing edge, and the plurality of chordwise grooves comprises a longer chordwise groove and a shorter chordwise groove, the longer chordwise groove extending between the leading edge and the trailing edge a first length, and the shorter chordwise groove extending between the leading edge and the trailing edge a second length that is less than the first length.

6. The blade assembly of claim 5, wherein the second length is about half of the first length.

7. The blade assembly of claim 5, wherein the longer chordwise groove extends closer to both the leading edge and the trailing edge than the shorter chordwise groove.

8. The blade assembly of claim 1, wherein the blade tip is a portion of a turbine blade.

9. The blade assembly of claim 1, further including a shelf established in the blade tip.

10. A blade assembly, comprising:

a blade tip at a radial end portion of a blade, the blade tip including a nonrecessed area and recessed area provided by a plurality of grooves open exclusively on a radially facing side, wherein the nonrecessed area is greater than the recessed area, wherein the plurality of grooves each extend lengthwise between a leading edge and a trailing edge of the blade tip, and the plurality of grooves each have a width that is about the same.

11. The blade assembly of claim 10, wherein the recessed area and the nonrecessed area each have at least one radially facing surface and an area of the radially facing surface of the nonrecessed area is greater than an area of the radially facing surface of the recessed area.

12. The blade assembly of claim 10, wherein at least one of the grooves has a contour that is different than both a contour of a pressure side of the blade tip and a contour of a suction side of the blade tip.

13. The blade assembly of claim 10, wherein the grooves extend lengthwise between the leading edge and the trailing edge of the blade tip.

14. The blade assembly of claim 10, wherein the blade tip includes a plurality of cooling holes.

15. The blade assembly of claim 10, wherein the plurality of grooves each have a depth and a width, and the depth divided by the width is from 0.5 to 3.0.

16. A method of controlling flow over a blade tip, comprising:

directing flow over the blade tip into at least a first groove and a second groove, the first groove and the second groove established within the blade tip and open exclusively on a radially facing side of the blade tip, wherein the blade tip has a nonrecessed area and a recessed area, the first groove and the second groove providing at least a portion of the recessed area, the nonrecessed area greater than the recessed area.

17. The method of claim 16, wherein the first groove and the second groove are both longitudinally extending.

18. The method of claim 16, wherein at least one of the grooves has a contour that is different than both a contour of a pressure side of the blade tip and a contour of a suction side of the blade tip.

* * * * *